United States Patent [19]

Nishida

[11] Patent Number: 4,533,291

[45] Date of Patent: Aug. 6, 1985

[54] TURNOVER DEVICE

[75] Inventor: Kenji Nishida, Matsuto, Japan

[73] Assignee: Kabushiki Kaisha Komatsu Seisakusho, Tokyo, Japan

[21] Appl. No.: 639,138

[22] Filed: Aug. 9, 1984

[30] Foreign Application Priority Data

Aug. 10, 1983 [JP] Japan ..... 58-123231[U]

[51] Int. Cl.[3] ..... B65G 47/24

[52] U.S. Cl. ..... 414/728; 100/207; 198/403; 414/759; 414/771; 414/774

[58] Field of Search ..... 414/728, 742, 758, 759, 414/761, 763, 771, 773, 774, 775, 783; 198/403, 410; 100/207

[56] References Cited

U.S. PATENT DOCUMENTS

| | | | |
|---|---|---|---|
| 763,307 | 6/1904 | Mills | 414/783 X |
| 2,916,164 | 12/1959 | Avery | 414/742 X |
| 3,780,882 | 12/1973 | Wagner | 414/759 |
| 4,378,592 | 3/1983 | Heiberger et al. | 100/207 X |
| 4,381,170 | 4/1983 | Orii | 198/403 X |

FOREIGN PATENT DOCUMENTS

| | | | |
|---|---|---|---|
| 2353215 | 5/1974 | Fed. Rep. of Germany | 414/774 |
| 1356362 | 6/1974 | United Kingdom | 198/410 |

*Primary Examiner*—Leslie J. Paperner

*Attorney, Agent, or Firm*—Frost & Jacobs

[57] ABSTRACT

A novel turnover device adapted to receive a workpiece at its inlet end and deliver the workpiece in a turned over state from its outlet end at a distance from the inlet end is disclosed herein, which comprises a main body frame, first and second carriers supported on the main body frame so as to be movable in the inlet-outlet direction, first and second arm holders rotatably supported by the first and second carriers, respectively, first and second arm rods slidably held by the first and second arm holders, respectively, first and second workpiece holders fixedly secured to one end of the first and second crank drive mechanisms associated with the first and second carriers, respectively, and adapted to rock the first and second rods, respectively, in the inlet-outlet direction when the carriers are moved in the inlet-outlet direction, and carrier drive means for driving the first and second carriers simultaneously in the opposite directions so that they may approach to each other and they may separate from each other.

4 Claims, 3 Drawing Figures

TURNOVER DEVICE

BACKGROUND OF THE INVENTION

The present invention relates to a turnover device for a workpiece, and more particularly to a turnover device suitable to be equipped in a large-sized metal die press line.

Heretofore, a turnover device for turning over a workpiece automatically has been known, and in a press line such turnover device is often equipped between one press station and the next press station. However, in the prior art, not only the turnover device was complexed in structure and difficult in design and required a large space, but also transfer mechanisms had to be equipped between one press station and the turnover device and between the turnover device and the next press station. Such as arrangement in a press line in the prior art is disclosed, for example, in U.S. Pat. No. 4,378,592 granted to Francis E. Heiberger et al.

SUMMARY OF THE INVENTION

It is therefore one object of the present invention to provide a turnover device which is simple in structure and easy in design.

Another object of the present invention is to provide a turnover device which can simultaneously achieve turnover and transfer functions with a minimum occupation space.

According to one feature of the present invention, there is provided a turnover device adapted to receive a workpiece at its inlet end and deliver the workpiece in a turned over state from its outlet end at a distance from the inlet end, which device comprises a main body frame, first and second carriers supported on the main body frame so as to be movable in the inlet-outlet direction, first and second arm holders rotatably supported by the first and second carriers, respectively, first and second arm rods slidably held by the first and second arm holders, respectively, first and second workpiece holders fixedly secured to one end of the first and second arm rods, respectively, and adapted to detachably hold the workpiece, first and second crank drive mechanisms associated with the first and second carriers, respectively, and adapted to rock the first and second arm rods, respectively, in the inlet-outlet direction when the carriers are moved in the inlet-outlet direction, and carrier drive means for driving the first and second carriers simultaneously in the opposite directions so that they may approach to each other and they may separate from each other.

According to another feature of the present invention there is provided the above-featured turnover device, in which each of the workpiece holders is fixedly secured at an angle to one end of the corresponding arm rod so that at the outermost positions, that is, at the inlet and outlet end positions of the first and second carriers, the workpiece holders may take a horizontal attitude, and at the innermost positions, that is, at the positions remote from the inlet and outlet end positions of the first and second carriers, the workpiece holders may take a vertical attitude.

According to still another feature of the present invention, there is provided the first-featured turnover device, in which each of said crank drive mechanisms consists of a rack mounted on the main body frame along the reciprocating path of the corresponding carrier, a pinion gear, cranks and a shaft integrally connected with the pinion gear and the cranks and in turn rotatably supported from the corresponding carrier, the pinion gear is meshed with the corresponding rack, and a tip end of each of the cranks is pivotably coupled to the other end of the corresponding one of the first and second arm rods.

According to yet another feature of the present invention, there is provided the first-featured turnover device, in which the carrier drive means includes a swing lever supported at its center from the main body frame so as to be rotatable about a vertical axis, first and second tie rods pivotably coupled at their one ends to the opposite ends of the swing lever and also pivotably coupled at the other ends to the first and second carriers, respectively, and a drive mechanism for rotationally driving the swing lever about the vertical axis.

Owing to the above-featured construction, the turnover device according to the present invention is suitable to be equipped in a large-sized press line between one press station and the next press station without being associated with additional transfer mechanisms. More particularly, if the turnover device is equipped with its inlet end placed adjacent to one press station and with its outlet end placed adjacent to the next press station, a workpiece loaded on the first workpiece holder positioned at the inlet end in a horizontal attitude can be transferred to a central position between the inlet and outlet ends while being turned by 90° into a vertical attitude by means of the first carrier and the associated mechanisms, and then the workpiece is reloaded on the second workpiece holder at the central position in a vertical attitude to be transferred to the outlet end position while being turned by 90° into a horizontal attitude by means of the second carrier and the associated mechanisms. Moreover, the turnover device according to the present invention is simple in structure and easy in design and necessitates a small occupation space as compared to the combination of a turnover device and transfer mechanisms in the prior art.

The above-mentioned and other objects, features and advantages of the present invention will become more apparent by reference to the following description of one preferred embodiment of the invention taken in conjunction with the accompanying drawings.

BRIEF DESCRIPTION OF THE DRAWINGS

In the accompanying drawings

DESCRIPTION OF A PREFERRED EMBODIMENT

Figure 1:
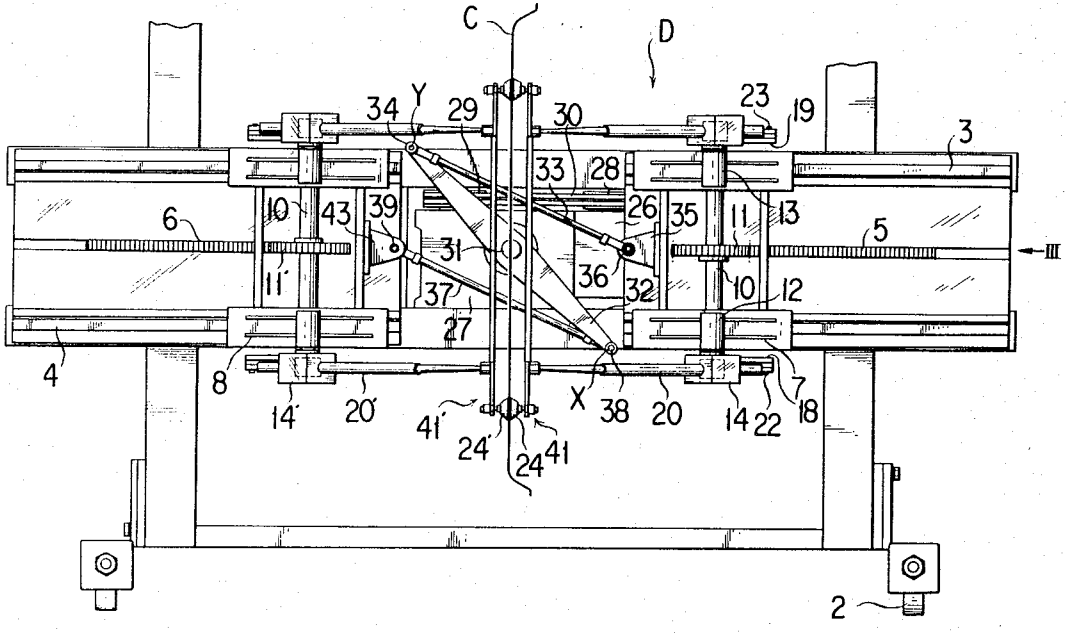
FIG. 1 is a schematic plan view showing one preferred embodiment of the present invention.
Figure 2:
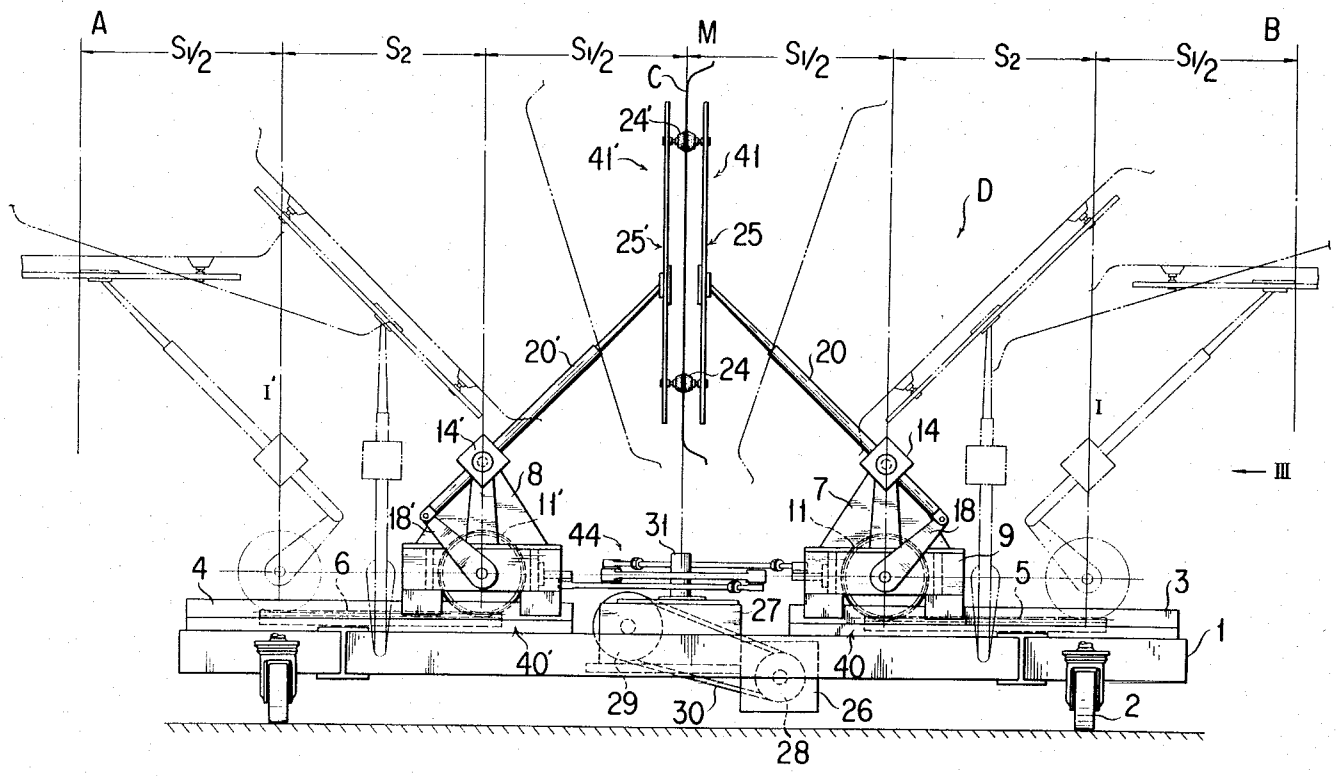
FIG. 2 is a schematic elevational view of the structure shown in FIG. 1.
Figure 3:
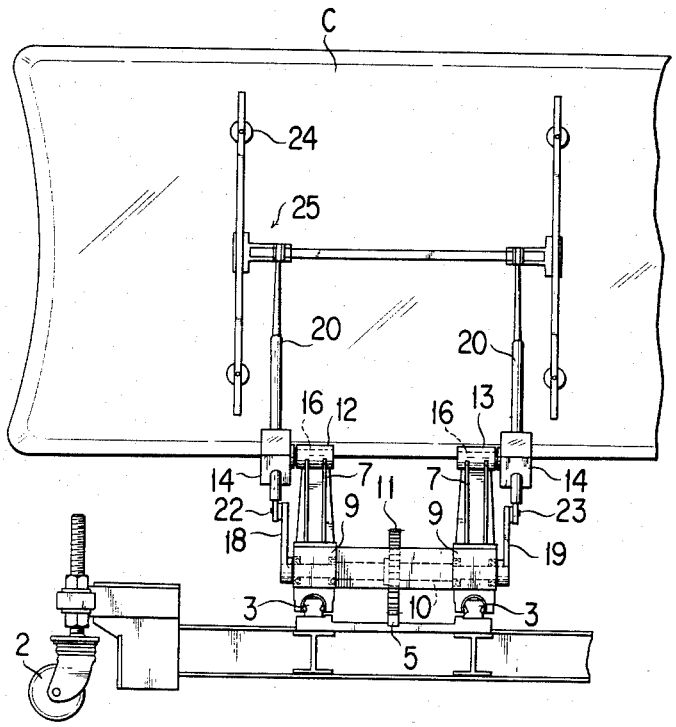
FIG. 3 is a schematic end view of the same structure as viewed in the direction of arrows III in FIGS. 1 and 2.

In FIGS. 1 to 3, reference numeral 1 designates a main body frame, and casters 2 are mounted to the main body frame so that the turnover device can be moved as a whole to a desired position in a plant. For the sake of explanation, it is assumed that a workpiece is received at the left end (that is, at the inlet end) of the turnover device and is delivered from the right end (that is, from the outlet end) of the device in a turned over state, as viewed in FIGS. 1 and 2. In that means, throughout this specification the left side or the inlet side is called "rear side", and the right side or the outlet side is called "front side". On the front and rear side portions of the main body frame 1 are mounted front and rear slide rail pairs 3 and 4, respectively, and also front and rear racks 5 and 6 are mounted on the front and rear portions of the main body frame 1 in parallel to the respective slide rail pairs 3 and 4. On the front slide rail pair 3 is movably provided a front carrier 7, and on the rear slide rail pair 4 is movably provided a rear carrier 8.

At the lower portion of the front carrier 7 are formed support sections 9, a shaft 10 is rotatably supported via ball bearings by the support sections 9, and a pinion gear 11 is fixedly secured to the shaft 10 and is meshed with the above-described rack 5. At the upper left and right portions of the front carrier 7 (as viewed in FIG. 3) are formed support sections 12 and 13, and pivot shafts 16, 16 of arm rod holders 14, 14 are rotatably supported by the support sections 12 and 13, respectively. To the opposite end portions of the shaft 10 are fixedly secured crank levers 18 and 19, respectively. In holding bores of the arm holders 14, 14 are slidably mounted arm rods 20, 20 via ball bushes not shown. Base end portions of the arm rods 20, 20 are pivotably coupled to free ends of the crank levers 18 and 19, respectively, via pins 22 and 23. An attachment 25 provided with vacuum cups 24 is fixedly secured to the tip end of each of the corresponding arm rods 20, 20 so as to make a predetermined angle between the plane of the attachment 25 and the axis of the arm rod 20. With regard to the predetermined angle, description will be made later in connection to the operation of the turnover device. The above-described rack 5, pinion gear 11, shaft 10 and crank levers 18 and 19 jointly constitute a crank drive mechanism 40, and the attachment 25 and vacuum cups 24 jointly constitute a workpiece holder.

The rear carrier 8 and its associated members are made similarly to the front carrier 7 and its associated members, the equivalent members are designated by like reference numerals to the members associated with the front carrier 7 but primed, and further description thereof will be omitted.

At the center portion of the main body frame 1 are fixedly provided a servo motor 26 and a worm reduction mechanism 27, and a pulley 28 at an end of an output shaft of the servo motor 26 is coupled via a timing belt 30 to a pulley 29 at an end of an input shaft of the worm reduction mechanism 27.

A central portion of a swing lever 32 is fixedly mounted to an output shaft 31 of the worm reduction mechanism 27, one end portion of the swing lever 32 is pivotably coupled to one end of a tie rod 33 via a pin 34, the other end of the tie rod 33 is pivotably coupled via a pin 36 to a bracket 35 at a center portion of the front carrier 7.

The other end portion of the swing lever 32 is pivotably coupled to one end of a tie rod 37 via a pin 38, the other end of the tie rod 37 is pivotably coupled via a pin 39 to a bracket 43 at a center portion of the rear carrier 8, and these members as well as the rotational drive mechanism including the members 26, 27, 28, 29 and 31 jointly constitute carrier drive means 44.

Now description will be made on the operation of a turnover device D for a workpiece C constructed in the above-described manner.

The turnover device D is equipped between a station A and a next station B. In the case of a press line, the stations A and B are successive press stations.

In the initial condition, the front and rear carriers 7 and 8 are placed at the positions indicated by reference characters I and I', respectively. As seen in FIG. 2, in this initial condition both the attachment 25' associated with the rear carrier 8 and the attachment 25 associated with the front carrier 7 take a horizontal attitude. In other words, the angle formed between the attachment 25 or 25' and the arm rod 20 or 20' is selected such that the attachments 25 and 25' can take a horizontal attitude in the illustrated initial condition.

Under the above-mentioned initial condition, a workpiece C which has finished to be pressed at the press station A is loaded on the attachment 25' in a horizontal state and is fixedly secured to the attachment 25' by a suction effect of the vacuum cups 24' as shown by double-dot chain lines in FIG. 2. Then, the servo motor 26 is actuated in rotation, hence the output shaft 31 of the worm reduction mechanism 27 is rotated through the pulley 28, timing belt 30 and pulley 29, and rotates the swing lever 32 in the anticlockwise direction as viewed in FIG. 1, and so, both the front carrier 7 and the rear carrier 8 are simultaneously moved inwardly from the positions I and I', respectively, by a distance $S_2$ as indicated in FIG. 2 up to the positions shown in FIG. 1. More particularly, the front carrier 7 is moved from the position I leftwardly by a distance $S_2$, while the rear carrier 8 is moved from the position I' rightwardly by a distance $S_2$. During these movements of the front and rear carriers 7 and 8, due to the meshing engagement between the pinion gear 11 and the front rack 5 and between the pinion gear 11' and the rear rack 6, the pinion gear 11 and the cranks 18 and 19 are rotated in the clockwise direction by a predetermined angle, and the pinion gear 11' and the cranks 18' and 19' are rotated in the anticlockwise direction by a predetermined angle as viewed in FIG. 2. Consequently, the arm rods 20 are rotated in the anticlockwise direction while sliding through the holding bores of the arm holders 14, 14, and the arm rods 20' are rotated in the clockwise direction while sliding through the holding bores of the arm holders 14', 14' as viewed in FIG. 2, and eventually, these members take the positions shown by solid lines in FIGS. 1 and 2. In other words, when the front carrier 7 and the rear carrier 8 take their innermost positions illustrated by solid lines in FIGS. 1 and 2, the attachment 25' fixedly holding the workpiece C takes a vertical attitude placing the holding plane for the workpiece along a vertical plane M at the midpoint M between the stations A and B, and at the same time the other attachment 25 also takes a vertical attitude placing the holding plane for the workpiece along the same vertical plane M. Therefore, under this condition, the workpiece C is detached from the attachment 25' by releasing the suction effects of the vacuum cups 24' and is attached to the attachment 25 by actuating the suction effects of the vacuum cups 24. Thus the workpiece C is transferred from the attachment 25' to the attachment 25 while maintaining the vertical attitude, that is, while turning over the attitude relative to the attachments 25' and 25.

Subsequently, the servo motor 26 is rotated in the reverse direction to rotate the swing lever 32 in the clockwise direction as viewed in FIG. 1, and thereby the front and rear carriers 7 and 8 are moved up to their outermost positions I and I', respectively, via the tie rods 33 and 37. During this movement of the front carrier 7, the pinion gear 11 is rotationally driven by the rack 5, hence the crank levers 18 and 19 are rocked in the anticlockwise direction as viewed in FIG. 2, and thereby the tip ends of the arm rods 20, 20 are rocked forwardly while sliding along the holding bores of the arm holders 14, 14 to deliver the workpiece C from the outlet end of the turnover device D to the next press station B. Then the suction effects of the vacuum cups 24 are released to free the workpiece C from the attachment 25 for loading into the press station B.

Reviewing the above-described series of operations, with regard to transfer functions of the front and rear carriers 7 and 8, the respective carriers transfer the center points of the workpiece C in the horizontal direction, that is, in the inlet-outlet direction by a distance of $S_1/2+S_2+S_1/2=S_1+S_2$ as seen in FIG. 2, and hence the total horizontal stroke S of the front and rear carriers 7 and 8 is represented by $S=2(S_1+S_2)$. On the other hand, with regard to turnover functions of the front and rear carriers 7 and 8, the front carrier 7 rotates the workpiece C about its center point by 90° in the clockwise direction between the position A and the position M, and the rear carrier 8 rotates the workpiece C about its center point by 90° in the clockwise direction between the position M and the position B, as viewed in FIG. 2. After all, the illustrated turnover device D can transfer the workpiece C by a distance $S=2(S_1+S_2)$ while rotating it by 180°, that is, while turning it over completely. Here, it is to be noted that a distance $S_1$ is a horizontal full stroke of the swing motion of the arm rods 20 and 20', and a distance $S_2$ is a stroke of the reciprocating motion of the carriers 7 and 8, as will be seen in FIG. 2.

In other words, according to the present invention, the turnover device can achieve both the turnover function and the transfer function simultaneously without necessitating additional transfer mechanisms. Moreover, as will be seen from the successive states of the workpiece C being turned over, which are shown in FIG. 2, the workpiece C is rotated, during its transfer motion, nearly about its center point, and thus the radius of rotation of the turnover operation can be made minimum. Therefore, the occupation space necessitated by this turnover device is small, and the turnover device is simple in structure and easy in design as compared to a combination of a turnover device and transfer mechanisms in the prior art.

Since many changes and modifications can be made to the above-described construction without departing from the spirit of the present invention, it is intended that all matter contained in the above description and illustrated in the accompanying drawings shall be interpreted to be illustrative and not as a limitation to the scope of the invention.

What is claimed is:

1. A turnover device adapted to receive a workpiece at its inlet end and deliver the workpiece in a turned over state from its outlet end at a distance from the inlet end, comprising a main body frame, first and second carriers supported on said main body frame so as to be movable in the inlet-outlet direction, first and second arm holders rotatably supported by said first and second carriers, respectively, first and second arm rods slidably held by said first and second arm holders, respectively, first and second workpiece holders fixedly secured to one end of said first and second arm rods, respectively, and adapted to detachably hold the workpiece, first and second crank drive mechanisms associated with said first and second carriers, respectively, and adapted to rock said first and second arm rods, respectively, in the inlet-outlet direction when said carriers are moved in the inlet-outlet direction, and carrier drive means for driving said first and second carriers simultaneously in the opposite directions so that they may approach to each other and they may separate from each other.

2. A turnover device as claimed in claim 1, in which each said workpiece holder is fixedly secured at an angle to one end of the corresponding arm rod so that at the outermost positions, that is, at the inlet and outlet end positions of the first and second carriers, said workpiece holders may take a horizontal attitude, and at the innermost positions, that is, at the positions remote from the inlet and outlet end positions of the first and second carriers, said workpiece holders may take a vertical attitude.

3. A turnover device as claimed in claim 1, in which each of said crank drive mechanisms consists of a rack mounted on said main body frame along the reciprocating path of the corresponding carrier, a pinion gear, cranks and a shaft integrally connected with said pinion gear and said cranks and in turn rotatably supported from the corresponding carrier, said pinion gear is meshed with the corresponding rack, and a tip end of each said crank is pivotably coupled to the other end of the corresponding one of said first and second arm rods.

4. A turnover device as claimed in claim 1, in which said carrier drive means includes a swing lever supported at its center from said frame main body so as to be rotatable about a vertical axis, first and second tie rods pivotably coupled at their one ends to the opposite ends of said swing lever and also pivotably coupled at the other ends to said first and second carriers, respectively, and a drive mechanism for rotationally driving said swing lever about said vertical axis.

* * * * *